US006237914B1

(12) United States Patent
Saltanov et al.

(10) Patent No.: US 6,237,914 B1
(45) Date of Patent: May 29, 2001

(54) MULTI DIMENSIONAL PUZZLE

(76) Inventors: Alexey Saltanov, 1568 Vista Club Cir., Apartment 309; YoungMi Kim, 1512 Vista Club Cir., Apartment 103, both of Santa Clara, CA (US) 95054

( * ) Notice: Subject to any disclaimer, the term of this patent is extended or adjusted under 35 U.S.C. 154(b) by 0 days.

(21) Appl. No.: 09/262,041

(22) Filed: Mar. 3, 1999

Related U.S. Application Data

(60) Provisional application No. 60/085,760, filed on May 14, 1998.

(51) Int. Cl.[7] ..... A63F 9/10
(52) U.S. Cl. ..... 273/157 R; 273/156
(58) Field of Search ..... 273/153 R, 156, 273/153 S, 157 R; 434/171, 172

(56) References Cited

U.S. PATENT DOCUMENTS

| | | | | |
|---|---|---|---|---|
| 176,144 | * | 4/1876 | McDougall | 273/157 R |
| 1,709,660 | * | 4/1929 | De Bracht | 273/157 R |
| 1,964,007 | * | 6/1934 | Parks | 273/157 R |
| 2,570,625 | * | 10/1951 | Zimmerman et al. | 273/157 R |
| 3,670,427 | * | 6/1972 | Stolpen | 434/172 |
| 3,672,681 | * | 6/1972 | Wolf | 273/157 R |
| 3,845,959 | | 11/1974 | Kosarek | 273/153 S |
| 3,993,313 | * | 11/1976 | Tillotson | 273/157 R |
| 4,257,606 | | 3/1981 | Launzel | 273/157 R |
| 4,257,609 | | 3/1981 | Squibbs | 273/241 |
| 4,308,016 | | 12/1981 | White | 434/96 |
| 4,424,971 | | 1/1984 | Clark | 273/153 S |
| 4,432,548 | | 2/1984 | Kassan | 273/153 S |
| 4,469,331 | | 9/1984 | Rinker | 273/157 R |
| 4,662,638 | | 5/1987 | Vachek | 273/160 |
| 4,874,176 | | 10/1989 | Auerbach | 273/157 R |
| 5,083,788 | | 1/1992 | Conotter | 273/153 S |
| 5,344,147 | | 9/1994 | Lee | 273/153 S |
| 5,393,063 | | 2/1995 | Ichimaru | 273/160 |
| 5,407,201 | * | 4/1995 | Whitehurst | 273/157 R |
| 5,762,336 | | 6/1998 | Miller, Jr. | 273/160 |
| 5,785,319 | | 7/1998 | Frauhiger | 273/157 R |
| 5,791,647 | | 8/1998 | Reiling | 273/157 R |
| 5,823,531 | | 10/1998 | Huber | 273/156 |
| 5,863,204 | * | 1/1999 | Fulton | 434/172 |

OTHER PUBLICATIONS

Advertising mailer of Handsome Rewards, "3–D Puzzles", 1 page, mailed on Mar. 9, 1999.
PCT Search Report dated Jul. 8, 1999 for Int'l Application No. PCT/US99/08992, 4 pages.

* cited by examiner

*Primary Examiner*—Steven Wong
(74) *Attorney, Agent, or Firm*—Blakely, Sokoloff, Taylor & Zafman LLP

(57) ABSTRACT

A puzzle including a plurality of pieces. Each of the plurality of pieces having a plurality of sides. A plurality of image segments are located on the plurality of sides of the puzzle pieces. The pieces may be coupleable in a predetermined manner to form a plurality of complete images from the plurality of image segments. The image segments that form a particular complete image reside on at least two different planes and at least one of the plurality of pieces having image segments corresponding to at least two of the plurality of complete images.

11 Claims, 10 Drawing Sheets

MULTI DIMENSIONAL PUZZLE

REFERENCE TO RELATED APPLICATION

This application claims the benefit of U.S. Provisional Application No. 60/085,760 filed May 14, 1998.

FIELD OF THE INVENTION

This invention relates to the field of puzzles and, more specifically, to three dimensional puzzles.

BACKGROUND

Prior puzzles have used sets of cubes in conjunction with pictures to form picture puzzles. In one prior cube puzzle, pictures are divided into segments with the picture segments applied to different sides of cube pieces that are connected to form the cube puzzle. The puzzle requires correct positioning of the cube pieces in order to reform the pictures from the picture segments on each side of the puzzle cube.

FIGS. 1, 2, and 3 illustrate two-dimensional views of images 10, 20, and 30, respectively, that may be used on different sides of a puzzle. Each of the images in FIGS. 1, 2, and 3 are assembled on a single plane. If each image is a simple two dimensional puzzle and each of the individual puzzle pieces are represented by the smaller squares, for example, square 31, then it would be relatively easy to disassemble the puzzle, mix up the puzzle pieces, and then reassemble the pieces into the original images using the images as a guide.

FIG. 4 illustrates a three-dimensional block view of a prior art cube puzzle 40 where multiple images reside on different sides of the cube and each of the individual images are formed in a single plane. Since puzzle 40 is a cube there would be a total of six images (one image per side of the cube). However, only three images 41, 42, and 43 are able to be shown in the FIG. 4. In this prior art cube puzzle, an individual puzzle piece is in the shape of a block or cube. Each of the puzzle pieces must be matched up appropriately to form all of the images that the particular piece is a part. This is particularly true on the corners where each individual comer puzzle piece would have a portion of three different images on three different sides and on the edge pieces where each individual edge puzzle piece would have a portion of two different images on two different sides.

To disassemble and then reassemble the type of cube puzzle illustrated in FIG. 4 may be more challenging than a puzzle containing a single two-dimensional single image such as puzzle images 10, 20, and 30 illustrated in FIGS. 1, 2, and 3, respectively, because of the multiple images, all on different sides of the cube puzzle 40. However, such puzzles may be still be of limited challenge because they do not require the three dimensional orientation of picture segments, forming a complete picture, in multiple planes relative to each other.

SUMMARY OF THE INVENTION

The present invention pertains to a puzzle including a plurality of pieces. Each of the plurality of pieces having a plurality of sides. A plurality of image segments are located on the plurality of sides of the puzzle pieces. The pieces may be coupleable in a predetermined manner to form a plurality of complete images from the plurality of image segments. The image segments that form a particular complete image reside on at least two different planes and at least one of the plurality of pieces having image segments corresponding to at least two of the plurality of complete images.

In one embodiment, a computer usable medium having a computer readable program code means for displaying a puzzle is provided. The computer readable program code may include a first code segment for displaying a plurality of puzzle pieces having a plurality of image segments, a second code segment for rotating the plurality of puzzle pieces to view the plurality of image segments, and a third code segment for connecting the plurality of pieces to form a plurality of complete images from the plurality of image segments, the image segments forming a particular complete image residing on at least two different planes, at least one of the plurality of pieces having image segments corresponding to at least two of the plurality of complete images. The computer readable program may also include a fourth code segment for rotating the puzzle to view the plurality of complete images.

Additional features and advantages of the present invention will be apparent from the accompanying drawings and from the detailed description that follows.

BRIEF DESCRIPTION OF THE DRAWINGS

The present invention is illustrated by way of example, and not by way of limitation, in the figures of the accompanying drawings and in which.

DETAILED DESCRIPTION

A puzzle having image segments on multi-tiered puzzle piece surfaces that can be taken apart and put back together again to form complete images is described. Intended advantages of the embodiments disclosed herein is to provide a more complex puzzle with images not necessarily entirely represented on the same plane of the puzzle when the puzzle pieces containing the images are reassembled in a multi-tiered fashion. Additional complexity may be added by increasing the number of sides of the puzzle, increasing the number of image segments forming a complete image on a side of the puzzle, or by changing the type of image used.

In the following description, numerous specific details are set forth such as examples of specific materials, patterns, components, etc. in order to provide a thorough understanding of the present invention. It will be obvious, however, to one skilled in the art that these specific details need not be employed to practice the present invention. In other instances, well known materials or methods have not been described in detail in order to avoid unnecessarily obscuring the present invention.

Figure 1:
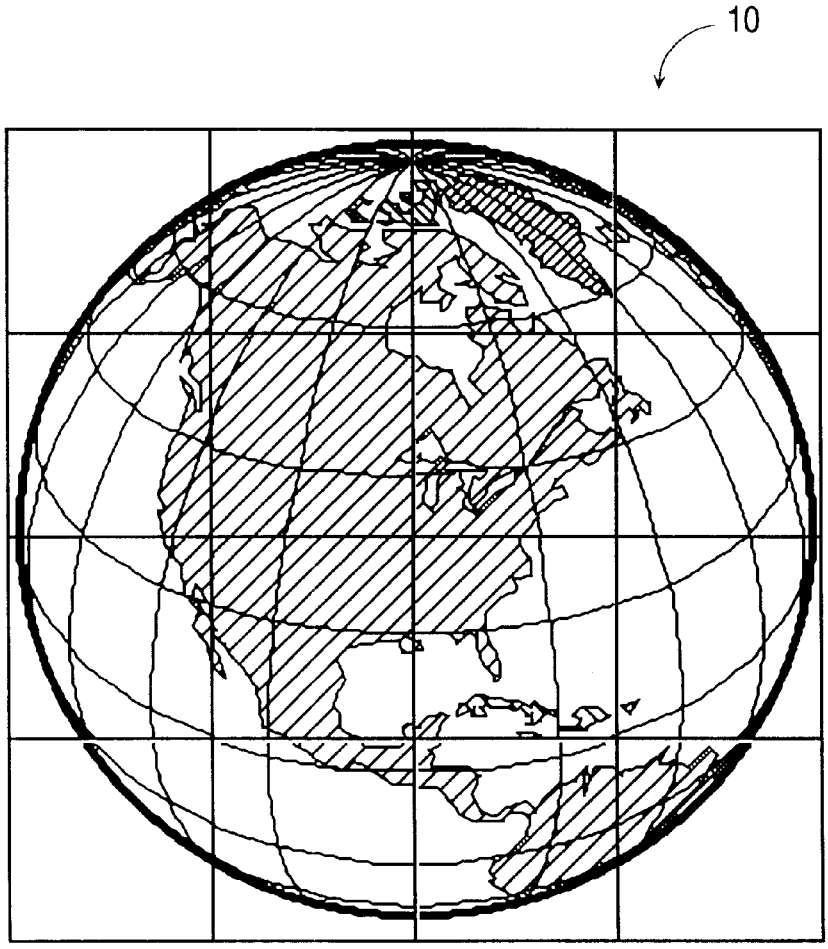
FIG. 1 (PRIOR ART)
FIG. 1 illustrates a two-dimensional front view of one side of a prior art cube puzzle.
Figure 2:
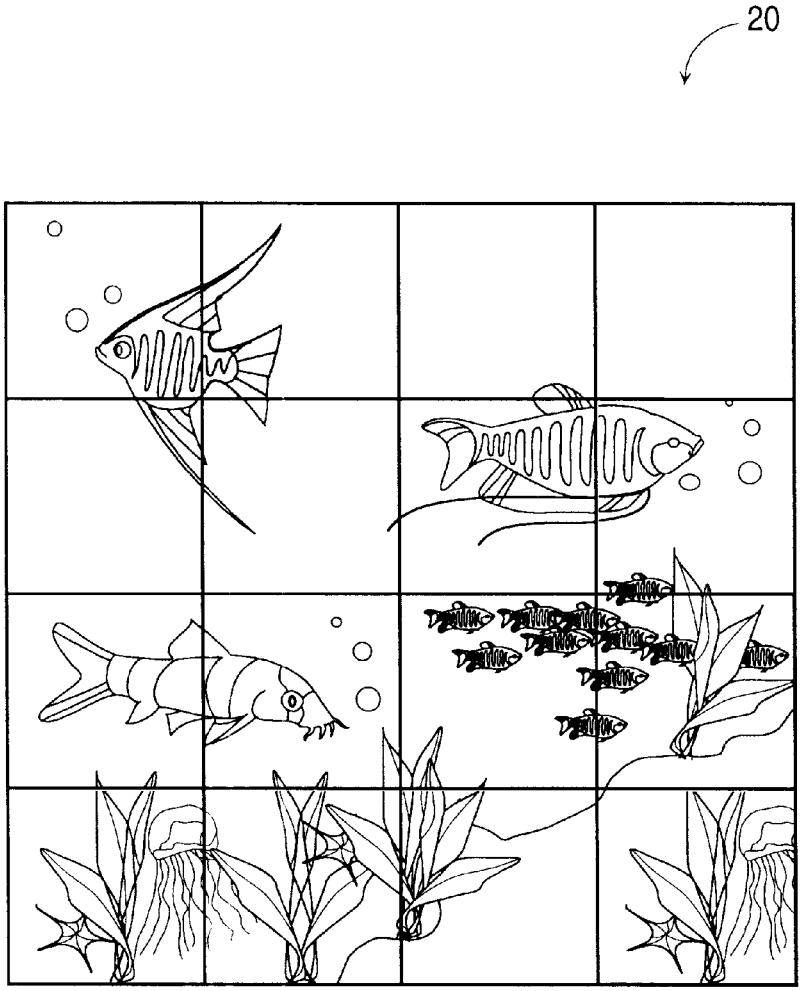
FIG. 2 (PRIOR ART)
FIG. 2 illustrates a two-dimensional top view of one side of a prior art cube puzzle.
Figure 3:
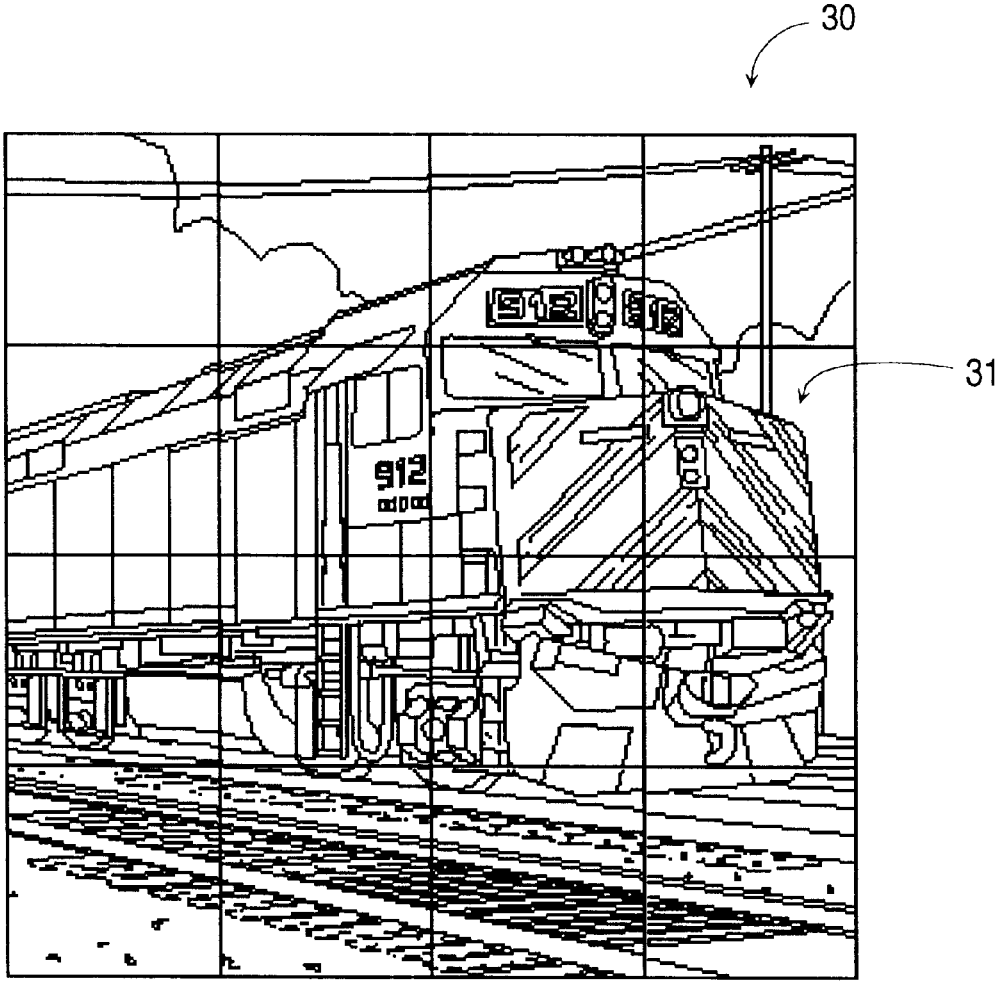
FIG. 3 (PRIOR ART)
FIG. 3 illustrates a two-dimensional side view of one side of a prior art cube puzzle.
Figure 4:
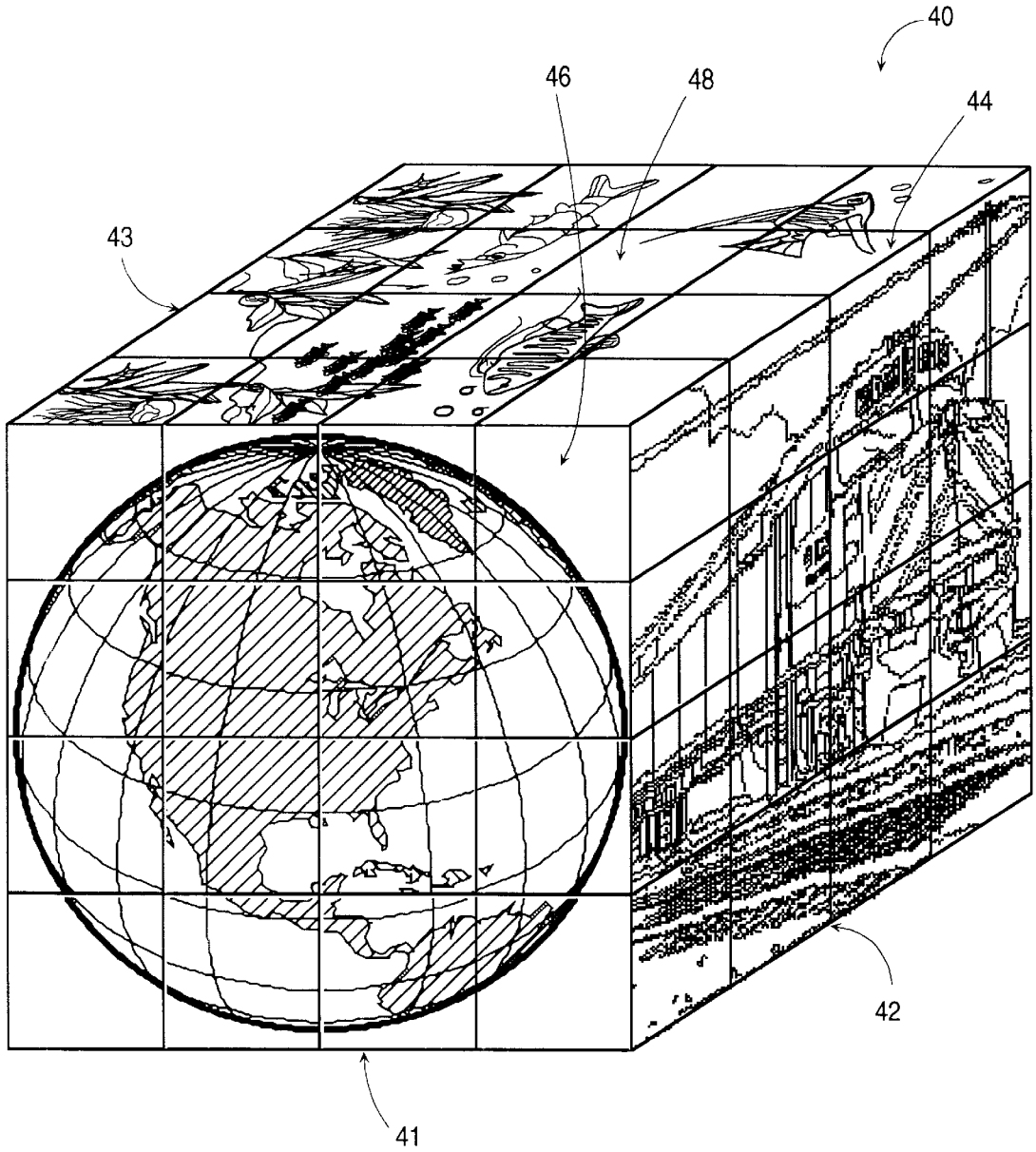
FIG. 4 (PRIOR ART)
FIG. 4 illustrates a three-dimensional block view of a prior art cube puzzle.
Figure 5:
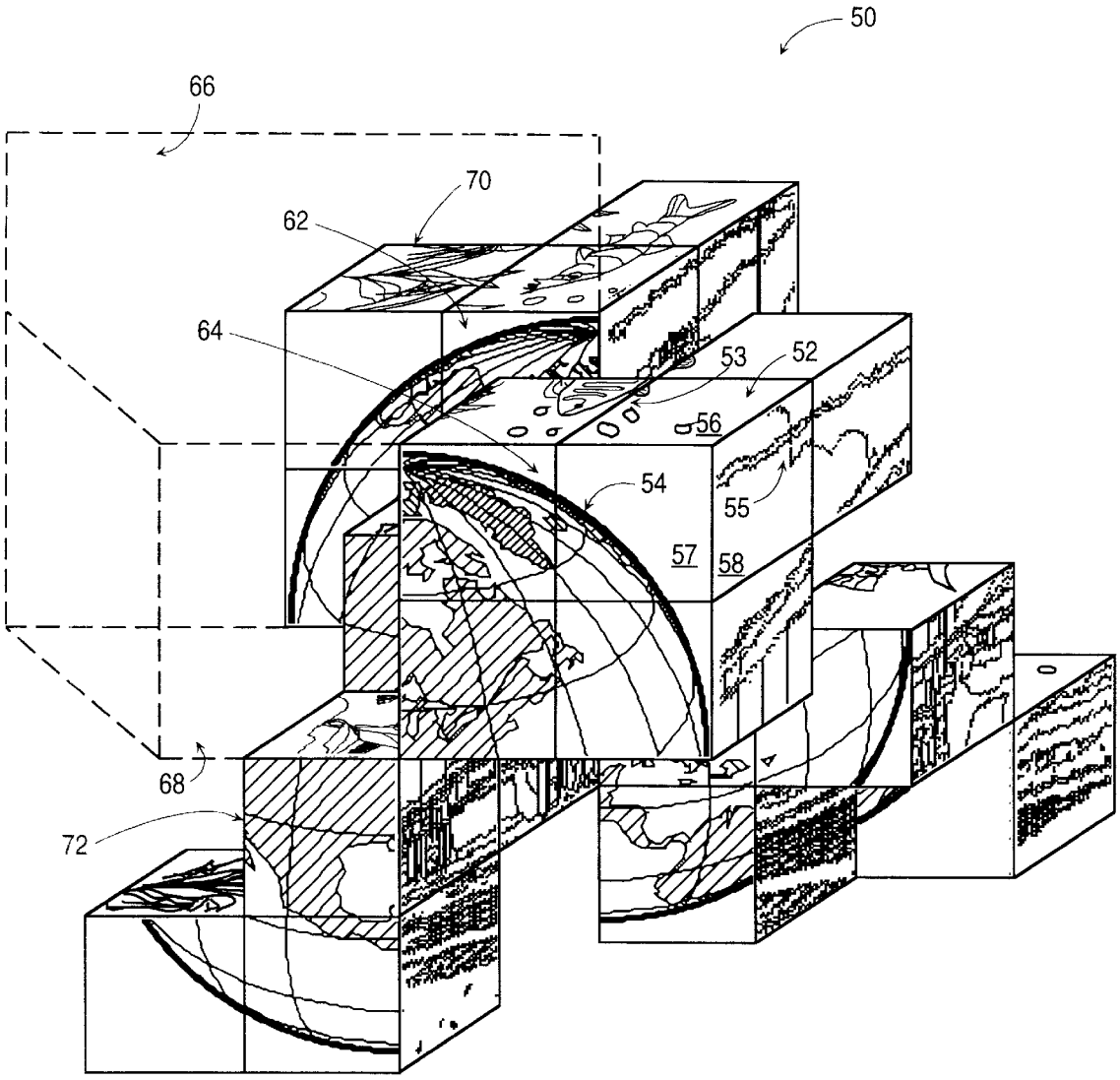
FIG. 5 illustrates a multi-dimensional view of a puzzle according to one embodiment of the present invention.

FIG. 5 illustrates a multi-dimensional view of a puzzle according to one embodiment of the present invention. It should be noted that the images shown in FIG. 5 are similar to the images shown in FIGS. 1, 2, 3, and 4 only for ease of illustration and are not meant to suggest similarities in the structure of the puzzles. Referring to FIG. 5, each of the puzzle pieces have image segments that must be matched up appropriately to form all of the complete images that each of the particular pieces are a part. For example, corner piece 52 of FIG. 5 has image segments of three different images 53, 54, and 55 on three different sides 56, 57, and 58, respectively. In the puzzle illustrated in FIG. 5, the image segments, on each of the puzzle piece's sides, forming a particular complete image do not necessarily reside on a single plane. When puzzle 50 is completely assembled, all of the sides of the puzzle 50 are not necessarily flat or planar. Instead, the sides have multiple terraces (i.e., multi-tiered), making the images on the sides of puzzle 50 multi-dimensional.

For example, in one embodiment, image segment 62 and image segment 64 are on different planes 66 and 68, respectively, that are parallel to each other. If puzzle 50 were viewed at approximately 90 degrees to planes 66 and 68, a complete image would be visible (with all the image segments visually unified) similar to that of FIG. 1. However the puzzle pieces, and their corresponding image segments, would not be completely planar because some of the pieces would be set in the forefront and other pieces would be set more in the background, or recessed. This configuration creates levels within a complete image when viewed at angles greater than approximately 90 degrees to planes containing the image segments. In the same manner, if puzzle 50 were viewed at approximately 90 degrees (i.e., perpendicular) to the plane containing image segment 58 or the plane containing image segment 55, complete images would be visible corresponding to the complete images in FIG. 2 and FIG. 3, respectively.

The puzzle 50 of FIG. 5 is more complex than that of puzzle 40 in FIG. 4 because of the multiple planes in which the images may have to be reconstructed to complete the puzzle. The multiple planes may prevent a person from determining the location of a piece based on the number of sides of the piece that contain an image segment. In the puzzle 40 of FIG. 4, an individual puzzle piece having image segments of two sides must be an edge piece, for example, piece 44. An individual puzzle piece having image segments on three sides must be a comer piece, for example, piece 46. An individual puzzle piece having an image segment on only one side must be an inside piece, for example, piece 48. However, in puzzle 50 of FIG. 5, the number of sides of a piece having image segments does not necessarily determine its location in the puzzle. For example, puzzle pieces 70 and 72 of FIG. 5 each have four sides containing image segments and two sides containing mechanisms for connection to other puzzle pieces. However, piece 70 is an edge piece while piece 72 is an inside piece. Thus, the placement of such puzzle pieces may be more difficult to solve.

Figure 6:
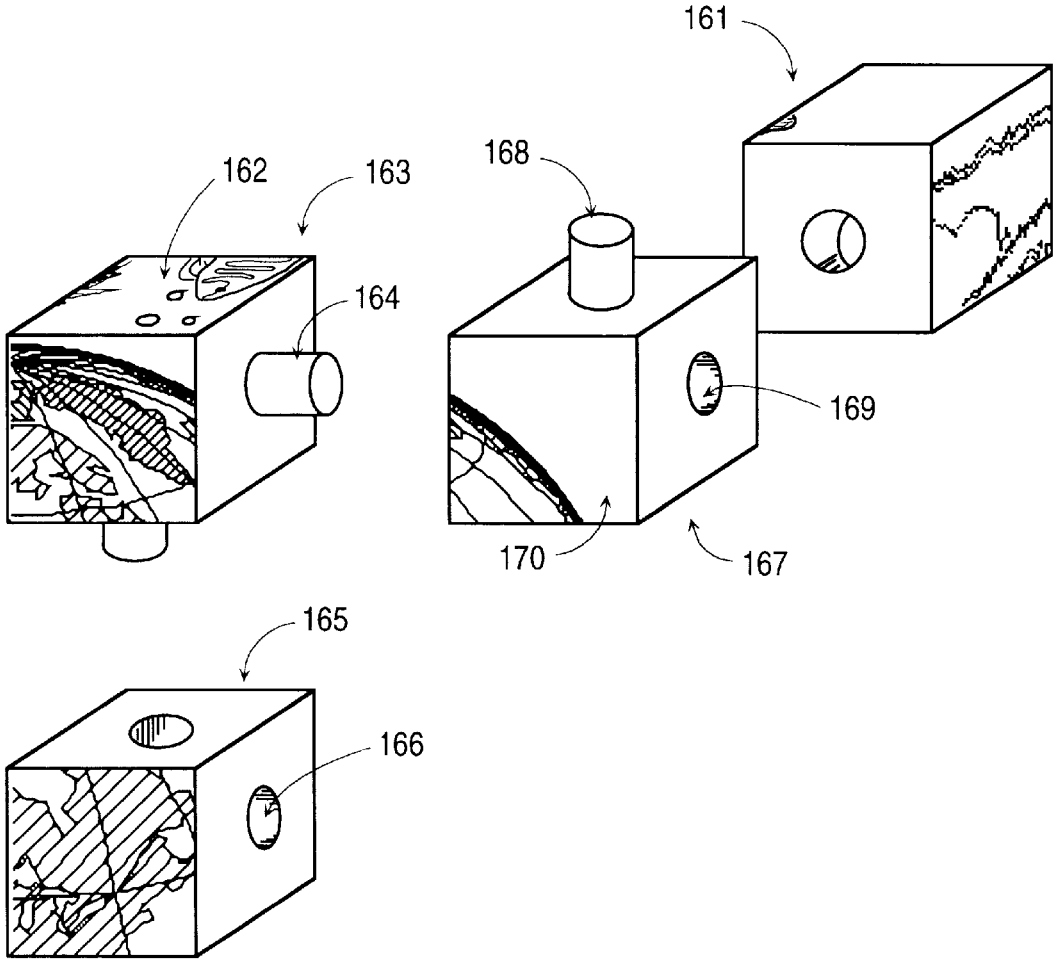
FIG. 6 illustrates puzzle pieces and their interconnecting portions according to one embodiment of the present invention.

FIG. 6 illustrates examples of puzzle pieces and their interconnecting portions according to one embodiment of the present invention. In one embodiment, the pieces are interconnected using pins that may be inserted into holes. For example, piece 163 has a pin 164, piece 165 has a hole 168, and piece 167 has both a hole 167 and a pin 168 on sides that do not contain image segments. Piece 161 has a hole on one of its sides and image segments on its other sides. Piece 167 has neither a pin nor a hole on its side containing image segment 170. The pins and holes interconnect the pieces and hold them in position to form the complete puzzle. It should be noted however, that other methods for holding the individual puzzle pieces together may also be used, for example, the individual pieces may be formed with interlocking tabs and grooves or the pieces may be magnetic.

Figure 7:
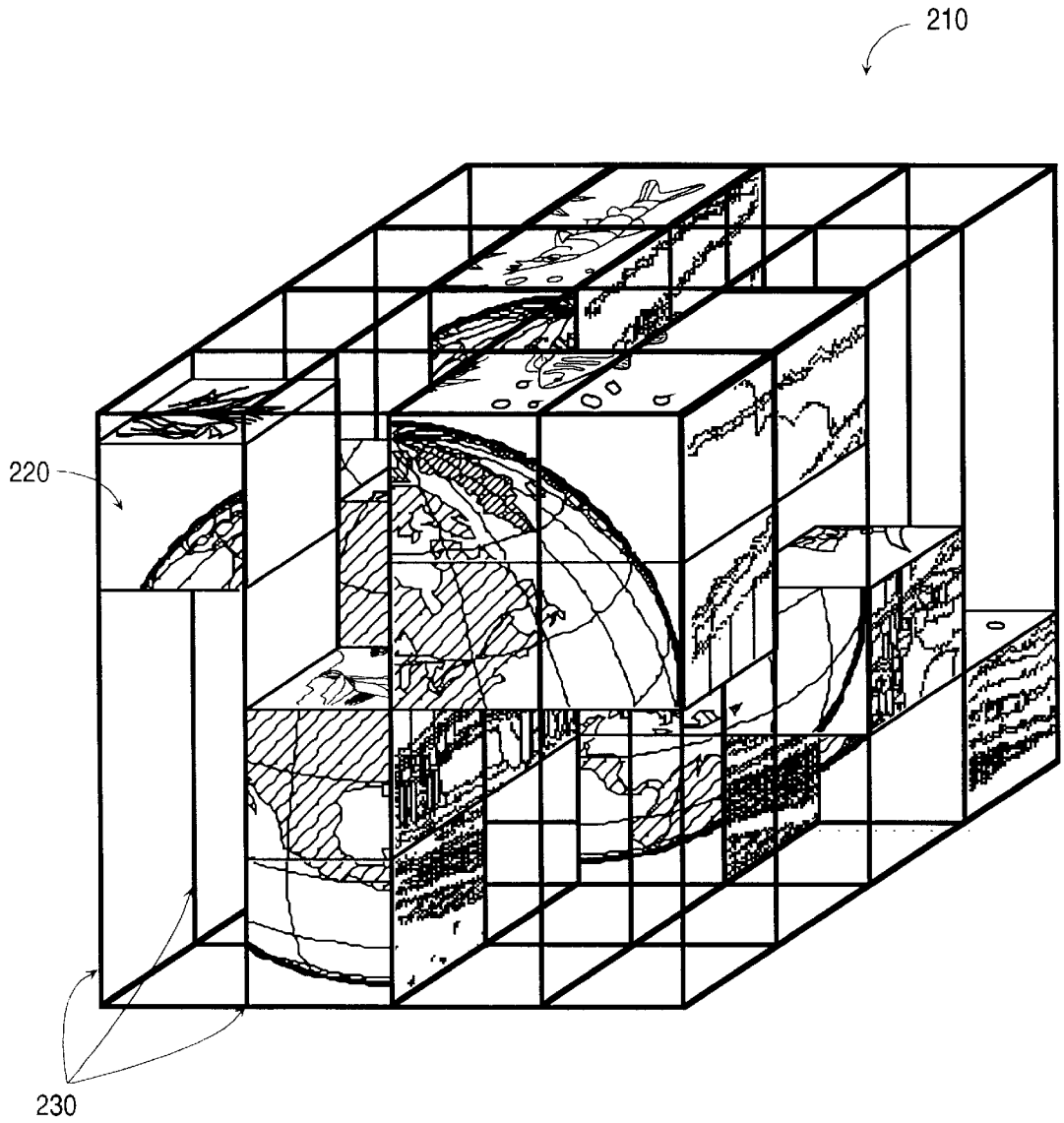
FIG. 7 illustrates a puzzle having a frame according to another embodiment of the present invention.

FIG. 7 illustrates a puzzle having a frame according to another embodiment of the present invention. A frame 210 is used to hold the pieces in position so that the image segments on the pieces form complete images when viewed at approximately a perpendicular angle to any side of the frame. A piece 220 is slid into position and is held in place by friction from the channels 230 of the frame 210. In another embodiment, the frame may be other shapes, for example, a pyramid or a cylinder.

Figure 8:
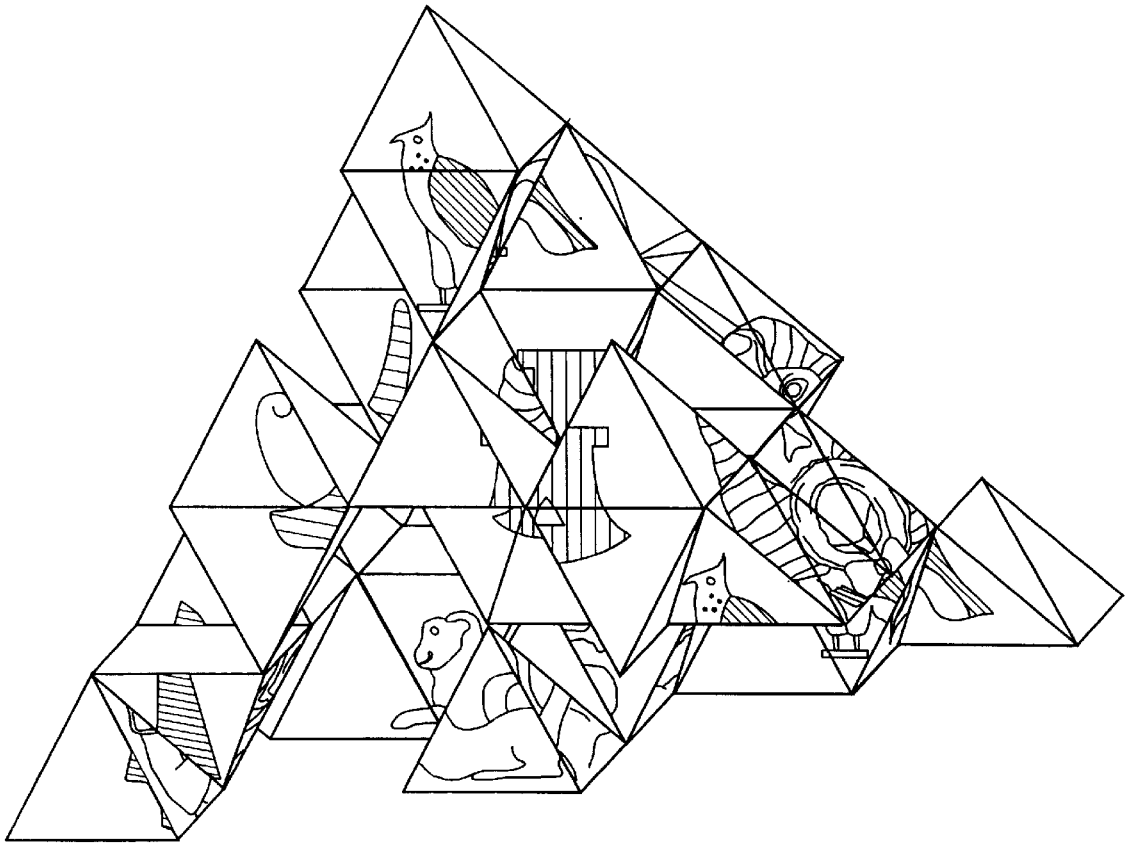
FIG. 8 illustrates a three-dimensional view of a puzzle according to another embodiment of the present invention.
Figure 9:
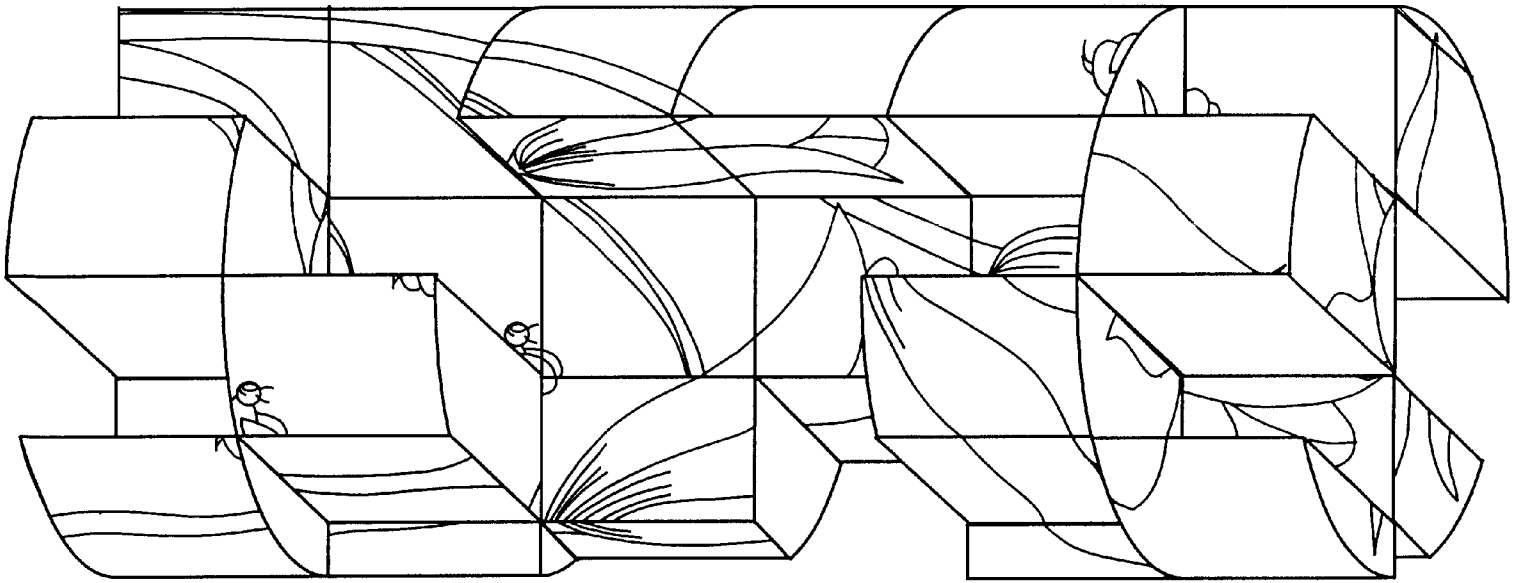
FIG. 9 illustrates a three-dimensional view of a puzzle according to yet another embodiment of the present invention.

It should also be noted that the puzzle may come in other shapes than the cube as described herein, for example, a rectangle (not shown), a pyramid as illustrated in FIG. 8, a sphere (not shown), or a cylinder as illustrated in FIG. 9. In another embodiment, the puzzle pieces may be in the form of other shapes, for example, a cube, a triangle, a pyramid, a polyhedron, or a cylinder. Although the description herein illustrates the puzzle as having individual pieces that all have the same shape, the individual puzzle pieces may also be of varying shapes within the same puzzle such that a single puzzle includes several differently shaped puzzle pieces.

In another embodiment, the complexity of the puzzle is increased by creating a more complex structure for the pieces to be assembled into. In yet another embodiment, the complete images include more complex shapes and patterns. For example, a complete image on one side of the puzzle may be formed by a collection of sub images, colors, or a combination thereof. The multi-tiered surface of the images creates a puzzle that is more difficult and more complex to solve than traditional puzzles.

In still another embodiment, the image segments are detachable from the puzzle pieces so that different image segments may be placed on the pieces to create new puzzle images. In one embodiment, the image segments are attached to the pieces using an adhesive. In another embodiment, the image segments may be attached by other methods, for example, magnetically.

Figure 10:
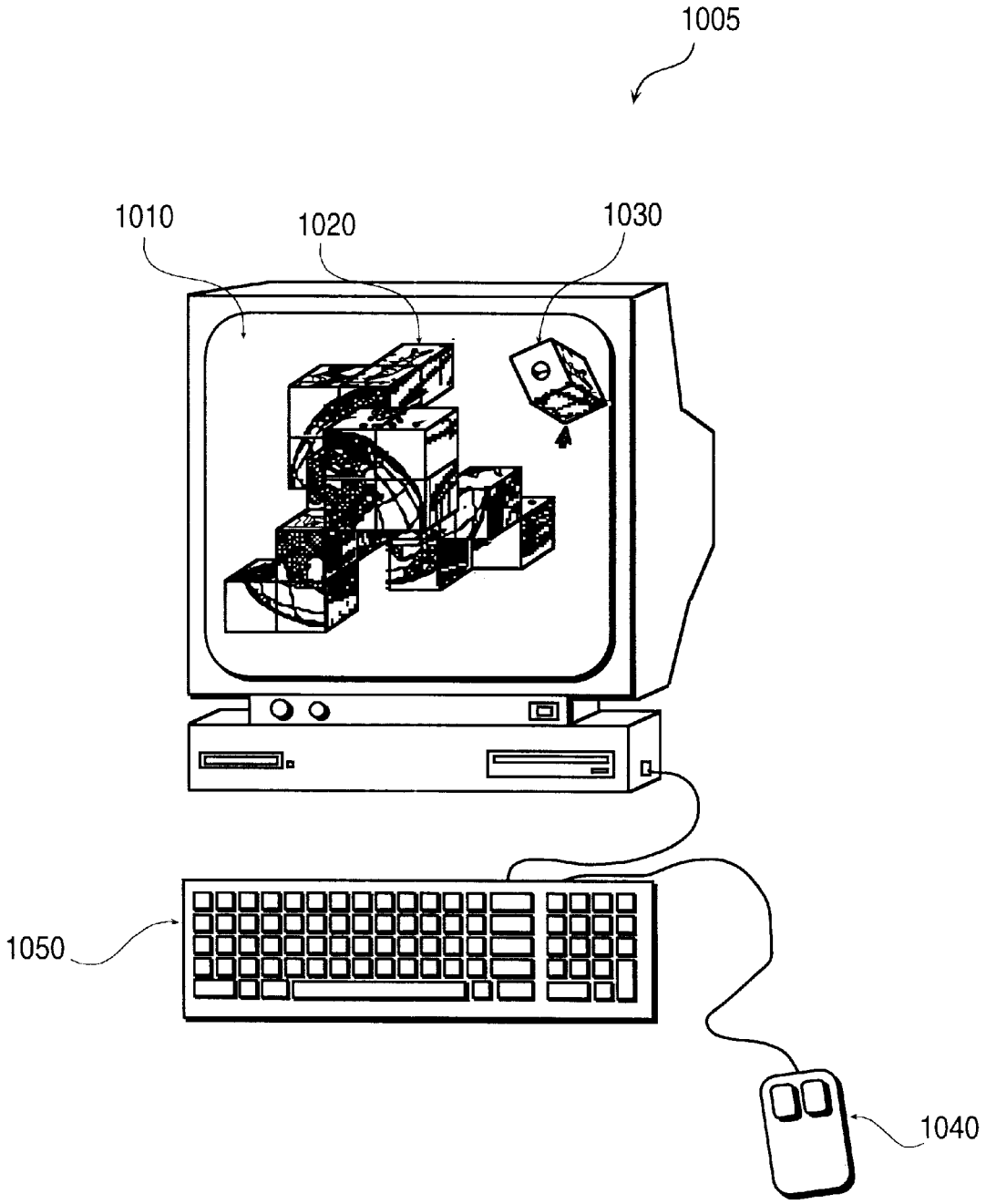
FIG. 10 illustrates a computer version of the puzzle according to another embodiment of the present invention.

FIG. 10 illustrates a computer version of the puzzle of the present invention. In one embodiment, the puzzle 1020 is represented as a computer generated three dimensional graphic on a computer screen 1010. Software code is written to enable a person to use an input device (e.g., mouse 1040 or keyboard 1050) of a computer system 1005 to select individual piece graphics, rotate piece graphics, and position piece graphics together. Piece graphic 1030 of FIG. 10 is shown in the process of being rotated. In another embodiment, the software code allows views of the puzzle graphic to be rotated so that a person can see image graphics of the puzzle and individual piece graphics from different perspectives. The puzzle piece graphics may be rotated and positioned next to each other so that the image segment graphics are matched up appropriately to form all of the complete image graphics that form the puzzle. The image segment graphics on each of the puzzle piece graphics are not necessarily visually represented on a single plane. Instead, the puzzle graphic is displayed having multiple terraces (i.e., multi-tiered), making the complete image graphics on the puzzle multi-dimensional.

In another embodiment, the puzzle piece graphics can be visually connected by positioning the puzzle piece graphics in channels of a frame graphic. It should be noted that the techniques for generating software to display and manipulate three dimensional graphics is well known to those skilled in the computer programming art and, thus, the details are not discussed herein.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A puzzle, comprising:

a plurality of pieces, each of the plurality of pieces having a plurality of sides; and a plurality of image segments on the plurality of sides, the pieces coupleable in a predetermined manner to form a plurality of complete images from the plurality of image segments, the image segments that form a particular complete image residing on at least two different planes, at least one of the plurality of pieces having image segments corresponding to at least two of the plurality of complete images, wherein the particular complete image is visibly formed when the puzzle is viewed at approximately 90 degrees to the different planes.

2. The puzzle of claim 1, wherein the plurality of pieces are coupleable by an interlocking mechanism.

3. The puzzle of claim 2, wherein the interlocking mechanism comprises a pin on one of the plurality of pieces insertable into a hole in another of the plurality of pieces.

4. The puzzle of claim 1, wherein the plurality of pieces are coupled together with a framework, the framework receiving the plurality of pieces to form the plurality of complete images.

5. The puzzle of claim 1, wherein the pieces are magnetically coupleable.

6. The puzzle of claim 1, wherein the plurality of pieces are cube shaped.

7. The puzzle of claim 1, wherein the plurality of pieces have a three-dimensional shape with sides selected from the group consisting of: a square, a triangle, a rectangle, a polyhedron, and a combination thereof.

8. The puzzle of claim 1, wherein one of the plurality of pieces is a different shape than another of the plurality of pieces.

9. The puzzle of claim 1, wherein the plurality of image segments are removable from the plurality of sides.

10. The puzzle of claim 1, wherein the plurality of pieces are computer generated graphics.

11. The puzzle of claim 10, wherein the plurality of pieces are visually coupleable on a display screen.

* * * * *